US005698855A

United States Patent [19]

Kaihara

[11] Patent Number: 5,698,855

[45] Date of Patent: Dec. 16, 1997

[54] ELECTRON GUN ASSEMBLY WITH IMPROVED HEAT RESISTANCE

[75] Inventor: Toshio Kaihara, Shiga, Japan

[73] Assignee: NEC Corporation, Tokyo, Japan

[21] Appl. No.: 680,837

[22] Filed: Jul. 16, 1996

[30] Foreign Application Priority Data

Jul. 17, 1995 [JP] Japan ..... 7-179734

[51] Int. Cl.[6] ..... H01J 29/48

[52] U.S. Cl. ..... 250/423 F; 313/412; 313/414; 313/479; 313/239; 313/326

[58] Field of Search ..... 250/423 F; 313/412, 313/414, 479, 239, 326

[56] References Cited

U.S. PATENT DOCUMENTS 3,766,427 10/1973 Coates et al. ..... 250/423 F
3,813,571 5/1974 Basiulis ..... 313/326

FOREIGN PATENT DOCUMENTS 60-91542 5/1985 Japan ..... 250/423 F

*Primary Examiner*—Jack I. Berman
*Attorney, Agent, or Firm*—Sughrue, Mion, Zinn, Macpeak & Seas, PLLC

[57] ABSTRACT

The present invention provides an electron gun assembly including at least one field emission type cold cathode acting as an electron beam source, a support for supporting the cold cathode thereon, a control electrode spaced away from the cold cathode, the control electrode cooperating with the support to enclose the cold cathode therein, a thermal shield member provided both around the control electrode and below the support to prevent heat conduction to the cold cathode. The thermal shield member does not allow heat conduction to the cold cathode when the electron gun assembly is to be enclosed in a glass valve by softening a neck portion of the glass valve with an oxygen burner and then attaching the softened neck portion to the electron gun assembly, resulting in that an emitter of the cold cathode is not increased in temperature and that a summit of an emitter is not oxidized. Thus, the work function of the cold cathode is not increased, and thereby there can be obtained a cathode ray tube including a field emission type cold cathode in which the emission performance is not degraded.

20 Claims, 3 Drawing Sheets

ELECTRON GUN ASSEMBLY WITH IMPROVED HEAT RESISTANCE

BACKGROUND OF THE INVENTION

1. Field of the Invention

The invention relates to an electron gun assembly to be used for a cathode ray tube (CRT), and more particularly to an electron gun assembly including field emission type cold cathodes having the improved heat resistance.

2. Description of the Related Art

FIGS. 1 and 2 illustrate an electron gun assembly to be used for a cathode ray tube, including a conventional hot cathodes. As illustrated in FIG. 1, the electron gun includes a plurality of hot cathodes 1, a reverse U-shaped support 2 for supporting the hot cathodes 1 by inserting them through holes (not numbered) formed with the support 2, a control electrode 3 having an electron emission surface 3*a* spaced away from the hot cathodes 1. The control electrode 3 is welded at a lower end thereof to the reverse U-shaped support 2. Leads 4 pass through a glass stem 5 and are connected to the hot cathodes 1. Power is provided to the hot cathodes 1 through the leads 4. An exhaust tube 6 is connected to the glass stem 5.

A cathode ray tube including the electron gun having the above mentioned structure is manufactured as follows. As illustrated in FIG. 2, the electron gun is inserted into a glass valve 7 so that the stem 5 is located almost in alignment with a neck portion 7*a* of the glass valve 7. Then, the neck portion 7*a* of the glass valve 7 is softened with an oxygen burner 8, and the neck portion 7*a* is made to be bonded to the stem 5. Then, air is exhausted through the exhaust tube 6, thereby the electron gun is made vacuous.

In manufacturing an electron gun, it is not avoidable that the stem 5 and nearby areas of the hot cathodes 1 are heated and thereby increased in temperature by radiant heat emitted from the oxygen burner 8.

If a field emission type cold cathode chip 11 illustrated in FIG. 3 is to be used in place of the hot cathodes 1, it is often impossible to obtain satisfactory performance of the chip 11 after the chip 11 has been mounted in a cathode ray tube, even if the chip 11 itself exhibits satisfactory performance when it is not mounted in a cathode ray tube. An improvement has been long desired.

By conducting many experiments, the inventor has found the reason why the cold cathode chip 11 mounted in a cathode ray tube exhibits unsatisfactory performance. As mentioned earlier, when an electron gun in which the cold cathode chip 11 is mounted is to be enclosed in a glass valve, the glass valve is softened by the oxygen burner 8. During the time the glass valve is heated by the oxygen burner 8, each of emitters 14 in the cold cathode chip 11 comes to have a temperature of 550° C. or greater at a surface thereof, and hence a surface of the emitters 14 is oxidized. In addition, since the emitters 14 are conically shaped and thus have a sharpened summit, oxidation occurs to a considerable depth from the summit, even though an oxidation depth from a surface of the emitters 14 is shallow. If a surface of an emitter is oxidized, the surface comes to have an increased work function. Thus, it is necessary to provide greater amount of energy to the emitter for electron emission, and hence the emitter would exhibit degradation in performance, if the emitter receives the same or non-increased gate voltage.

SUMMARY OF THE INVENTION

It is an object of the present invention to provide an electron gun assembly which can prevent emitters of cold cathodes from being exposed to high temperature, when an electron gun assembly including the cold cathodes is welded to a glass valve with a burner.

The present invention provides an electron gun assembly comprising at least one field emission type cold cathode acting as an electron beam source, a support for supporting the cold cathode thereon, and a thermal shield member for preventing heat conduction to the cold cathode. For instance, the thermal shield member is arranged to substantially enclose the cold cathode therein.

The present invention further provides an electron gun assembly including at least one field emission type cold cathode acting as an electron beam source, a support for supporting the cold cathode thereon, a control electrode spaced away from the cold cathode, the control electrode cooperating with the support to enclose the cold cathode therein, thermal shield material provided both around the control electrode and below the support to prevent heat conduction to the cold cathode.

By forming the thermal shield member around the cold cathodes, the radiant heat radiated from a burner is prevented from arriving the cold cathodes, and hence it is possible to keep the cold cathodes' temperature below 450° C. or smaller when the cold cathodes are enclosed in a glass valve. Thus, it is possible to avoid the oxidation of summits of the emitters, thereby desired emission performance being provided.

It is preferable that the thermal shield member is made of ceramic, glass or heat-resistant resin either alone or in combination thereof. The ceramic, glass and heat-resistant resin may have any color, but preferably have white.

The thermal shield member is preferably composed of a film, which may be formed by applying paste material. Since the cold cathode is manufactured by assembling many parts, it is necessary to form the film without being obstructed by convex and concave portions of assembled parts. Thus, the application of paste material to a surface of the cold cathode is a best choice, because the convex and concave portions are never hindrance to the application of paste material. In addition, it is preferable that the thermal shield means has a low thermal conductivity.

For instance, the support is made of a hermetical seal. The support on which the cold cathodes are supported is preferably designed to have a great thickness which constitutes a part of the thermal shield member. The support having a great thickness is also able to intercept heat conduction to the cold cathodes, thereby a temperature of emitters being not increased to the oxidation temperature.

It is preferable that the thermal shield member includes a heat reflection member. For instance, the heat reflection member is designed to have a mirror-polished layer. The mirror-polished layer is preferably formed at a surface of the thermal shield member located in the vicinity of a portion at which the electron gun assembly is to be heated. The provision of the heat reflection member such as a mirror-polished layer shortens time for softening a neck portion of a glass valve, and hence it is possible to shorten total time for attaching the electron gun assembly to a glass valve.

As mentioned earlier, in accordance with the present invention, radiant heat derived from an oxygen burner for softening a neck portion of a glass valve is intercepted by the thermal shield member. Thus, the thermal shield member does not allow heat conduction to the cold cathode when the electron gun assembly is to be enclosed in a glass valve, resulting in that an emitter of the cold cathode is not increased in temperature and that a summit of an emitter is not oxidized. Thus, the work function of the cold cathodes is not increased, and thereby there can be obtained a cathode ray tube including a field emission type cold cathode in which the emission performance is not degraded.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENT

Figure 4:
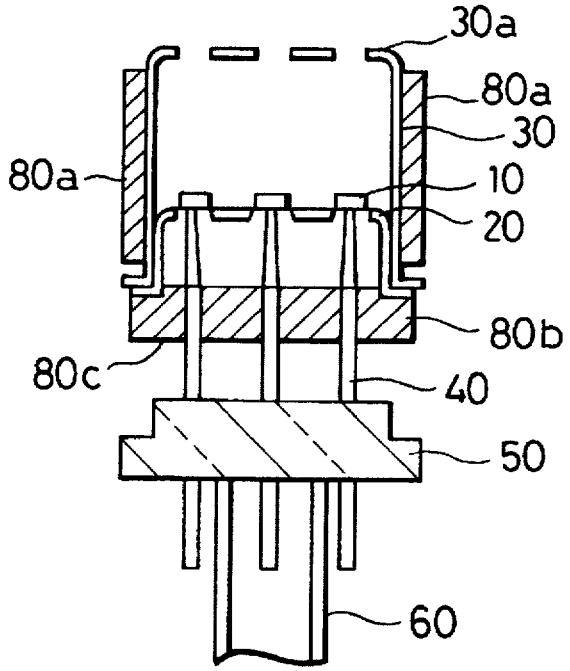
FIG. 4 is a cross-sectional view of an electron gun assembly made in accordance with the present invention.

A preferred embodiment in accordance with the present invention will be explained hereinbelow with reference to FIGS. 4 and 5.

An electron gun assembly includes a plurality of cold cathodes 10, which act as an electron source, supported on a reverse U-shaped support 20 by inserting the cold cathodes 10 through holes (not numbered) formed with the support 20. The support 20 is made of hermetic seal. A control electrode 30 having a reverse U-shaped cross-section is provided so that an electron emission surface 30*a* thereof is spaced away from the cold cathodes 10. Electrons transmitted from the cold cathodes 10 pass through the surface 30*a*. The control electrode 30 is formed at a lower end thereof with a flange portion. The control electrode 30 is fixedly attached to the support 20 by welding the flange portion to a flange portion of the support 20 formed at a lower end thereof. The same number of leads 40 as the cold cathodes 10 pass through a glass stem 50 and are connected to the cold cathodes 10. Power is provided to the cold cathodes 10 through the leads 40. An exhaust tube 60 is connected to the glass stem 50 which is to be bonded to a neck portion 70*a* of a glass valve 70.

A thermal shield member 80 by which the present invention is characterized is arranged to enclose the cold cathodes 10. As mentioned later, the thermal shield member 80 may be made of various material and arranged in many patterns.

Figure 1:
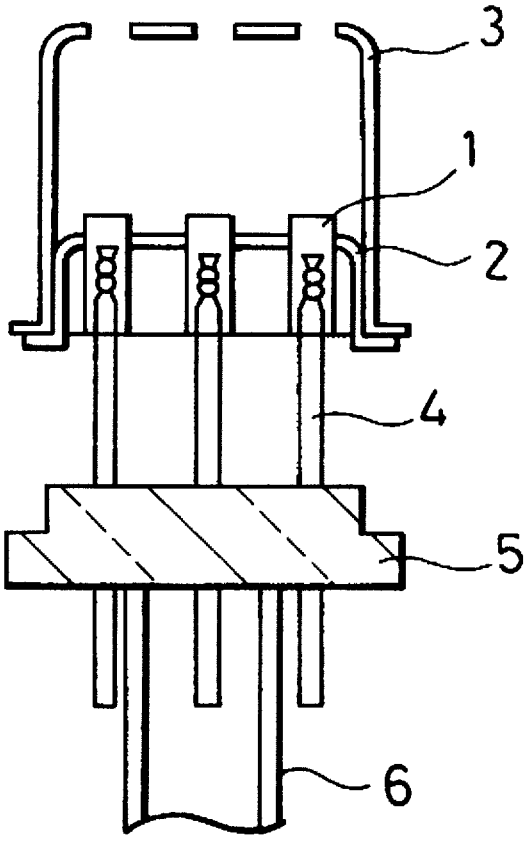
FIG. 1 PRIOR ART
FIG. 1 is a cross-sectional view of a conventional electron gun assembly.
Figure 2:
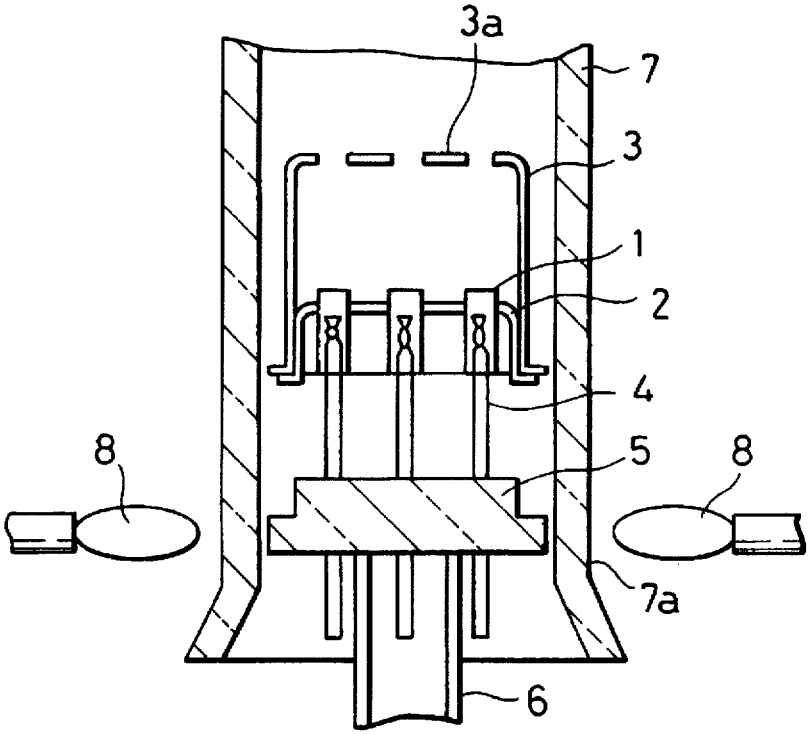
FIG. 2 PRIOR ART
FIG. 2 is a cross-sectional view of the electron gun assembly illustrated in FIG. 1, which is going to be bonded to a neck portion of a glass valve.
Figure 3:
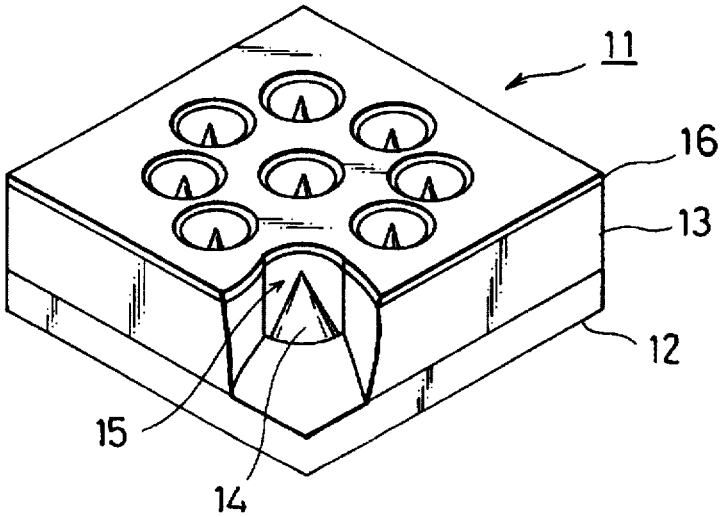
FIG. 3 is a perspective view of a cold cathode chip.

Each of the cold cathodes 10 is comprised of a cold cathode chip 11 as illustrated in FIG. 3. The cold cathode chip 11 is fabricated as follows. An insulating layer 13 is first formed on a substrate 12, and then a gate 16 is deposited over the insulating layer 13. The gate 16 is made of polysilicon, for instance. Then, a plurality of small holes 15 are formed throughout the gate 16 and insulating layer 13 by lithography and etching. Then, metal such as molybdenum (Mo) is deposited over the gate 16 by evaporation, thereby there being formed an emitter 14 in each of the holes 15. As illustrated in FIG. 3, the emitter has sharpened summit. Then, the metal deposited on the gate 16 is removed. Thus, the cold cathode chip 11 is completed.

The cold cathode chip 11 is attached on the support 20 by means of an adhesive such as silver paste and gold-silicon alloy. Since the emitters 14 have a greatly sharpened summit and the gate 16 is located very close to the summits of the emitters 14, there is produced an intensive field at the summits of the emitters 14 by applying a voltage in the range of a few volts to tens of volts across the emitters 14 and the gate 16, and thus electrons are emitted from the emitters 14. The electrons having emitted from a plurality of the emitters 14 are formed into an electron beam by field profile constituted by the control electrode 30. The electron beam runs along the same orbit as that of a conventional hot cathode electron gun, and is focused on a fluorescent screen.

In the embodiment, the control electrode 30 is surrounded with thermal shield member 80*a* around a circumferential surface thereof, and there is disposed thermal shield member 80*b* below the cold cathodes 10 supported on the support 20. The thermal shield members 80*a* and 80*b* intercept heat conduction to the cold cathodes 10, and thus prevent the emitters 14 of the cold cathode chips 11 from being increased in temperature and thus being oxidized.

The inventor conducted an experiment to confirm the performance of the electron gun assembly including the thermal shield members 80*a* and 80*b* made in accordance with the embodiment. The result was that the emitters 14 were never increased beyond 450° C. in temperature. Thus, it was confirmed that the electron gun assembly including the thermal shield members 80*a* and 80*b* could provide excellent oxidation-prevention effects.

The thermal shield members 80*a* and 80*b* are made of ceramic, glass or inorganic heat-resistant resin, and are white in color for absorbing less radiant heat thereinto.

The thermal shield members 80*a* and 80*b* may be made by die forming and bonded to the control electrode 30 and the support 20 by welding. However, the simplest method of making the thermal shield members 80*a* and 80*b* is to apply paste material such as frit glass and inorganic resin to the control electrode 30 and the support 20 to thereby form a film. This method is suitable for an electron gun assembly constituted by assembling many parts and hence having a lot of concave and convex portions.

Figure 5:
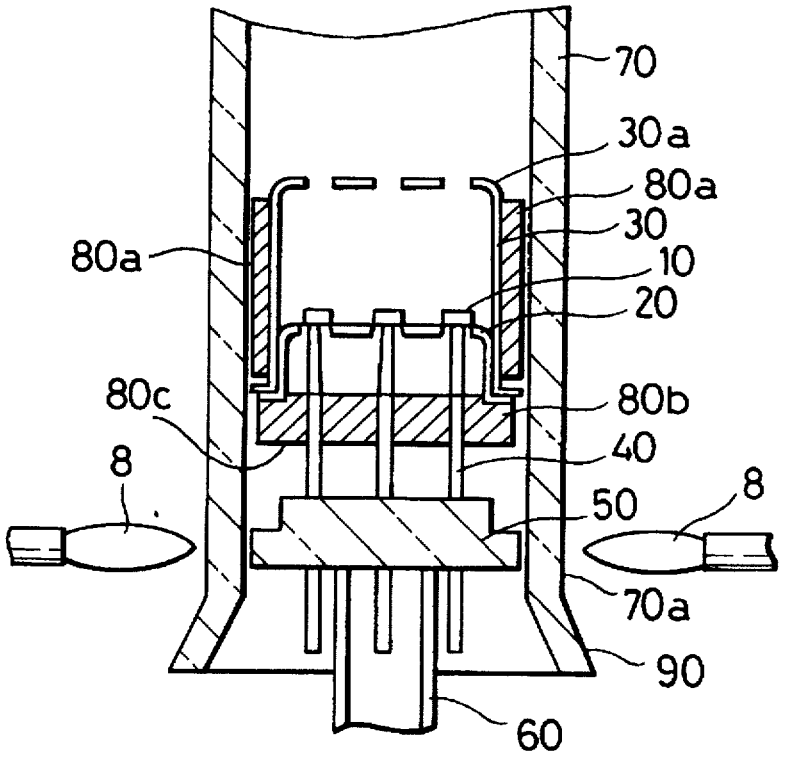
FIG. 5 is a cross-sectional view of the electron gun assembly illustrated in FIG. 4, which is going to be bonded to a neck portion of a glass valve.

The electron gun assembly which includes the thus fabricated cold cathodes 10 is inserted into a glass valve 70, as illustrated in FIG. 5, and then a neck portion 70*a* of the glass valve 70*a* is heated with the oxygen burner 8 to thereby weld the neck portion 70*a* to a glass stem 50.

When the thermal shield members 80*a* and 80*b* are made of ceramic and/or glass, there may be provided a means for heat reflection to the thermal shield members 80*a* and 80*b*. For instance, a mirror-polished layer 80*c* may be formed at a lower surface of the thermal shield member 80*b*. By locating the mirror-polished layer 80*c* in the vicinity of the neck portion 70*a* to which radiant heat is provided from the oxygen burner 8, the thermal shield effects can be enhanced. In addition, the mirror-polished layer 80*c* makes it possible to heat the neck portion 70*a* more rapidly to a melting point by virtue of the heat reflection effects, and thus it takes a shorter period of time to weld the neck portion 70*a* of the glass valve 70 to the stem 50, resulting in enhancement in productivity.

The mirror-polished layer may be formed around the thermal shield member 80*a* in combination with the thermal shield member 80*b*.

The means for heat reflection is not to be limited to the mirror-polished layer 80*c*, but includes any material and arrangement if they can reflect heat therewith.

After the neck portion 70*a* of the glass valve has been welded to the stem 50, a flared portion 90 of the glass valve 70 is cut off. Then, the glass valve 70 enclosing the electron gun assembly therein is exhausted through the exhaust tube 60. Thus, a cathode ray tube is completed.

In place of the formation of the thermal shield member 80*b*, there may be provided the support 20 which has a thickness great sufficient to prevent heat conduction therethrough. It is preferable that the thermal shield members 80*a* and 80*b* are made of material having a low thermal conductivity in order to prevent heat transfer therethrough.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. An electron gun assembly comprising:

at least one field emission type cold cathode acting as an electron beam source;

a support for supporting said cold cathode thereon; and thermal shield means for preventing heat conduction to said cold cathode.

2. The electron gun assembly as set forth in claim 1, wherein said thermal shield means substantially encloses said cold cathode therein.

3. The electron gun assembly as set forth in claim 1, wherein said thermal shield means is made of at least one of ceramic, glass and heat-resistant resin.

4. The electron gun assembly as set forth in claim 3, wherein said thermal shield means includes means for heat reflection.

5. The electron gun assembly as set forth in claim 1, wherein said thermal shield means is composed of a film.

6. The electron gun assembly as set forth in claim 5, wherein said film is formed by applying paste material.

7. The electron gun assembly as set forth in claim 1, wherein said support is designed to have a great thickness which constitutes a part of said thermal shield means.

8. The electron gun assembly as set forth in claim 1, wherein said thermal shield means has a low thermal conductivity.

9. The electron gun assembly as set forth in claim 1, wherein said forms a hermetic seal.

10. The electron gun assembly as set forth in claim 4, wherein said means for heat reflection is constituted of a mirror-polished layer.

11. The electron gun assembly as set forth in claim 10, wherein said mirror-polished layer is formed at a surface of said thermal shield means located in the vicinity of a portion at which said electron gun assembly is to be heated.

12. An electron gun assembly comprising:

at least one field emission type cold cathode acting as an electron beam source;

a support for supporting said cold cathode thereon;

a control electrode spaced away from said cold cathode, said control electrode cooperating with said support to enclose said cold cathode therein;

a thermal shield member provided both around said control electrode and below said support to prevent heat conduction to said cold cathode.

13. The electron gun assembly as set forth in claim 12, wherein said thermal shield member is made of at least one of ceramic, glass and heat-resistant resin.

14. The electron gun assembly as set forth in claim 13, wherein said thermal shield member includes means for heat reflection.

15. The electron gun assembly as set forth in claim 12, wherein said thermal shield member is composed of a film.

16. The electron gun assembly as set forth in claim 15, wherein said film is formed by applying paste material.

17. The electron gun assembly as set forth in claim 12, wherein said support is designed to have a great thickness which constitutes a part of said thermal shield member.

18. The electron gun assembly as set forth in claim 12, wherein said thermal shield member has a low thermal conductivity.

19. The electron gun assembly as set forth in claim 14, wherein said means for heat reflection has a mirror-polished layer.

20. The electron gun assembly as set forth in claim 19, wherein said mirror-polished layer is formed at a surface of said thermal shield member located in the vicinity of a portion at which said electron gun assembly is to be heated.

* * * * *